US007222371B2

(12) United States Patent
Houghton et al.

(10) Patent No.: US 7,222,371 B2
(45) Date of Patent: May 29, 2007

(54) SHAWL

(76) Inventors: Claire Houghton, 54 Union St., Whitefield, NH (US) 03598; Tami Roy, 21 Dugay St., Berlin, NH (US) 03570

( * ) Notice: Subject to any disclaimer, the term of this patent is extended or adjusted under 35 U.S.C. 154(b) by 0 days.

(21) Appl. No.: 10/955,228

(22) Filed: Sep. 30, 2004

(65) Prior Publication Data

US 2006/0064795 A1 Mar. 30, 2006

(51) Int. Cl.
*A41D 13/01* (2006.01)
*A41D 13/00* (2006.01)

(52) U.S. Cl. ..... 2/88; 2/69; 2/84

(58) Field of Classification Search ..... 2/88, 2/84, 85, 80, 83, 69, 69.5, 104–108, 114, 2/90, 93–95, 115, 125, 16, 275, 214, 273
See application file for complete search history.

(56) References Cited

U.S. PATENT DOCUMENTS 1,273,765 A * 7/1918 Gavin ..... 2/84
1,509,296 A * 9/1924 Hopewell ..... 2/88
1,774,577 A * 9/1930 Weinstein ..... 2/273
2,213,754 A * 9/1940 Hans ..... 280/810
3,144,660 A * 8/1964 Portaro ..... 2/88
4,316,288 A * 2/1982 Henrickson ..... 2/88
5,544,364 A * 8/1996 Weber ..... 2/104
5,553,323 A * 9/1996 Chou et al. ..... 2/114
5,570,474 A * 11/1996 Berry et al. ..... 2/104
6,536,049 B2 * 3/2003 Jastrab et al. ..... 2/88

* cited by examiner

*Primary Examiner*—Gloria M. Hale
(74) *Attorney, Agent, or Firm*—Michael J. Persson; Lawson & Persson, P.C.

(57) ABSTRACT

A shawl including a sheet of fabric having an inner surface and an outer surface defined by a top edge, a bottom edge, a right side edge and a left side edge. The sheet of fabric is dimensioned to allow the right and left hands of the user to each extend beyond the right edge and left edge of the sheet of fabric when the top edge of the sheet of fabric is draped over the user's shoulders. A right arm closure extends from the inner surface of the sheet of fabric proximate to the right edge, and a left arm closure extending from the inner surface of the sheet of fabric proximate to the left edge. Each of the arm closures has a width that is less than a width of a human forearm and defines an opening dimensioned to allow the user's hands to pass therethrough.

17 Claims, 5 Drawing Sheets

SHAWL

FIELD OF THE INVENTION

The present invention relates to the field of clothing and, in particular, to articles of clothing designed for use by people having physical limitations.

BACKGROUND OF THE INVENTION

Many people suffer from poor blood circulation, which results in their feeling cold and needing to add layers of clothing in order to be comfortable. Although poor circulation may affect people of all ages, this problem is especially acute in the elderly. Unfortunately, the elderly often have physical limitations that make the process of adding layers of clothing, and especially those articles of clothing having conventional sleeves, far more difficult. For example, people who have suffered a stroke, or other disease process that results in muscular contractures, are often unable to manipulate their arms to place them through the sleeves of a sweater or bathrobe. Similarly, manipulating their arms to place them through the sleeves of conventional garments can result in severe pain and/or muscle damage to people with existing shoulder injuries or arthritis. A number of different garments and methods have heretofore been used in order to meet the needs of these people.

One common approach has been to use oversized garments, such as sweaters or bathrobes, having large sleeves that are easier to manipulate over the arms and shoulders. An oversized garment is advantageous because is provides the user with needed warmth, will stay in place and not fall off during periods of activity, and may often be put on and secured without the aid of others. Unfortunately, this approach has significant drawbacks.

Many people take immense pride in their personal appearance and being forced to wear such ill fitting clothing can have a negative affect on their dignity and sense of self worth. It is now well established that a person's mental attitude is inexorably tied to their physical health and, in fact, the maintenance of a patient's personal appearance is but one of a plethora of "dignity issues" addressed by today's nursing care providers. As this approach requires a person to choose between physical comfort and personal dignity, it is not a viable solution for many people. Further, oversized sleeves are often hazardous to the user as they can interfere with the operation of a walker or wheelchair, or may drape over a burner of a stove and become ignited. Finally, such garments are not easily put on and taken off by the wearer, making it less likely that they will be momentarily removed to avoid a hazardous situation, or for the person to cool herself when her body temperature increases. Therefore, this approach is inadequate.

Another approach has been to utilize garments, such as hospital "jonnies", which are accessed through the rear of the garment. Many people who cannot manipulate their arms through the sleeves of a correctly sized sweater can extend their arms through the sleeves of a "jonnie". Further, "jonnies" may be made from a variety of fabrics and include stylish designs that allow the user to maintain their personal appearance. Finally, "jonnies" are typically secured onto the user and are not prone to falling off the user during periods of activity. Unfortunately, the need to secure "jonnies" from the rear creates significant disadvantages.

A person who cannot manipulate their arms through the sleeves of a sweater will certainly not be able to reach behind them to secure, or disengage, the buttons, zippers, ties, or other fasteners at the rear of a "jonnie". Therefore, a person would need assistance securing or removing the fasteners, which increases their dependence on others. Further, the person's inability to remove the "jonnie" may cause the person to overheat if the temperature of the room increases and may pose a serious safety hazard in the event that the "jonnie" was ignited. In addition, having the closure on the rear of the garment forces the person to sit or lie on the closure. Sitting on a zipper, hook and loop fastener, button, or the like, irritates the skin and can cause the person to form decubidous ulcers, commonly referred to as "bed sores", on their affected regions. Finally, traditional fabric ties expose the person's skin, causing them to be cold and to lose their sense of dignity. For these reasons, the use of such garments is also not an acceptable solution.

Still another approach has been to wrap a shawl over the shoulders of the person. Traditional shawls do not include any sleeves through which arms must be manipulated and can be made in a variety of different fabrics and can include ornamentation to make them look quite fashionable; allowing the person to retain their well kept appearance and dignity without sacrificing physical comfort. Further, shawls may be easily moved aside when cooking or manipulating a cane, walker or wheelchair; effectively reducing these safety hazards. Finally, shawls are relatively easy to put on and take off, and people with physical limitations may often be able to wrap a shawl around their own shoulders; eliminating the need for others to help them with this task and allowing them to maintain a higher degree of independence.

As was the case with the oversized garments and "jonnies" discussed above, the use of traditional shawls also has significant disadvantages. Traditional shawls or blankets are merely rectangular pieces of fabric that must be held in place by the person over whom it is draped. Unfortunately, the elderly often need to use their hands to grasp a cane or walker, or to steady themselves when moving from one place to another, resulting in the shawl being prone to slippage off of their shoulders. Such slippage can cause a myriad of problems. For example, retrieving a shawl from the ground, or from between one's back and the backrest of a wheelchair, can be a daunting task in itself for many people. Therefore, if no assistance is available, the person may not be able to retrieve the shawl to put it back on, causing them to be cold, or risk a fall or physical injury retrieving it. Fallen shawls may also interfere with walkers or wheelchairs, again posing safety hazards.

Therefore, there is a need for a garment that provides the user with needed warmth, will stay in place and not fall off during periods of activity, may be put on and taken off without the aid of others, does not irritate the skin with which it comes into contact, may be made to look fashionable to give pride and dignity to the wearer, and that provides people confined to a hospital or nursing home with a wardrobe choice that they wish to make and, consequently, that gives them a spark to have the energy to want to get dressed.

SUMMARY OF THE INVENTION

The present invention is an improved shawl that overcomes the above referenced drawbacks inherent in current garments. In its most basic form, the shawl includes a sheet of fabric having an inner surface and an outer surface defined by a top edge, a bottom edge, a right side edge and a left side edge. The sheet of fabric is dimensioned to allow the right and left hands of the user to each extend beyond the right edge and left edge of the sheet of fabric when the top edge of the sheet of fabric is draped over the user's shoulders. A right arm closure extends from the inner surface of the sheet of fabric proximate to the right edge, and a left arm closure extending from the inner surface of the sheet of fabric proximate to the left edge. Each of the arm closures has a width that is less than a width of a human forearm and defines an opening dimensioned to allow the user's hands to pass therethrough.

In operation, the user will drape the shawl over their shoulders such that the arm closures are substantially evenly disposed proximate to the user's hands. The user will then insert their hands through the closures and allow the closures to slide up to their forearms, which hold the shawl in place. This leaves the user's hands free to perform necessary tasks and insure that the shawl does not hinder the operation of a cane, walker or wheelchair. Further, because of the location of the closures relative to the hands, the hands may be easily withdrawn from the closures if the user is cooking, eating or performing other tasks with which interference by the shawl is to be avoided.

In the preferred embodiment, the right and left arm closures are formed as an integral part of the sheet of fabric. However, one or both of these closures may be separate and distinct form the sheet and may be fixedly or removably attached thereto. In some embodiments, the closures take the form of hook and loop fasteners made up of a first end and a second end that are mated together to form the closure.

The preferred embodiment of the shawl uses only the users forearms to retain the shawl in place. However, other embodiments include at least one closure disposed upon the sheet of fabric proximate to the top edge for securing the left and right sides of the top edge of the shawl together when the shawl is draped over the user. The preferred closures are hook and loop fasteners that are disposed at locations proximate to the top edge of the sheet of fabric such that the hook portion may be mated with the loop portion when the top edge of the sheet of fabric is draped over the pair of shoulders of the human user. These are preferred due to the ease with which such closures may be both fastened and removed. However, other art recognized closures, such as buttons, snaps of the like may be substituted to achieve similar results. In some embodiments, at least two closures are provided in order to allow at least a torso of the user to be substantially covered by the sheet of fabric, providing additional warmth to the user.

The preferred shawl is intended to cover only the torso of the user and is dimensioned such that the width dimension, measured between the right edge and the left edge, is greater than a length dimension, measured between the top edge and the bottom edge. However, in other embodiments, such as those for use with people who are ambulatory, that shawl is dimensioned to allow the bottom edge of sheet of fabric to extends below a knee of the user in a manner similar to that of a conventional bathrobe.

The preferred sheet of fabric is made up of two pieces of fabric that are joined together to form a shawl portion and a collar portion. The collar portion is designed to fold over on itself and the joining line is placed such that the collar falls easily over the users neck and shoulders. The joining line of this preferred embodiment terminates in a pair of notches that allow the user's arms a greater degree of freedom than would be possible were they restrained entirely by the sheet of fabric.

Finally, in some embodiments the shawl includes weights that are secured to the inner surface of the sheet of fabric proximate to the arm closures in order to reduce hand shaking that is common to people having a number of disease processes, including Parkinson's disease. These weights are preferably removably secured by inserting them into pockets formed in the inner surface of the sheet of fabric, but may be secured by attaching them via hook and loop fasteners or by permanently stitching them into the sheet of fabric.

Therefore, it is an aspect of the present invention to provide a garment that warms the user and prevents them from becoming cold.

It is a further aspect of the invention to provide a garment that will stay in place and not fall off during periods of activity.

It is a further aspect of the invention to provide a garment that may be put on and taken off without the aid of others.

It is a further aspect of the invention to provide a garment that does not compromise the user's dignity.

It is a still further aspect of the invention to provide a garment that and does not irritate the skin with which it comes into contact.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
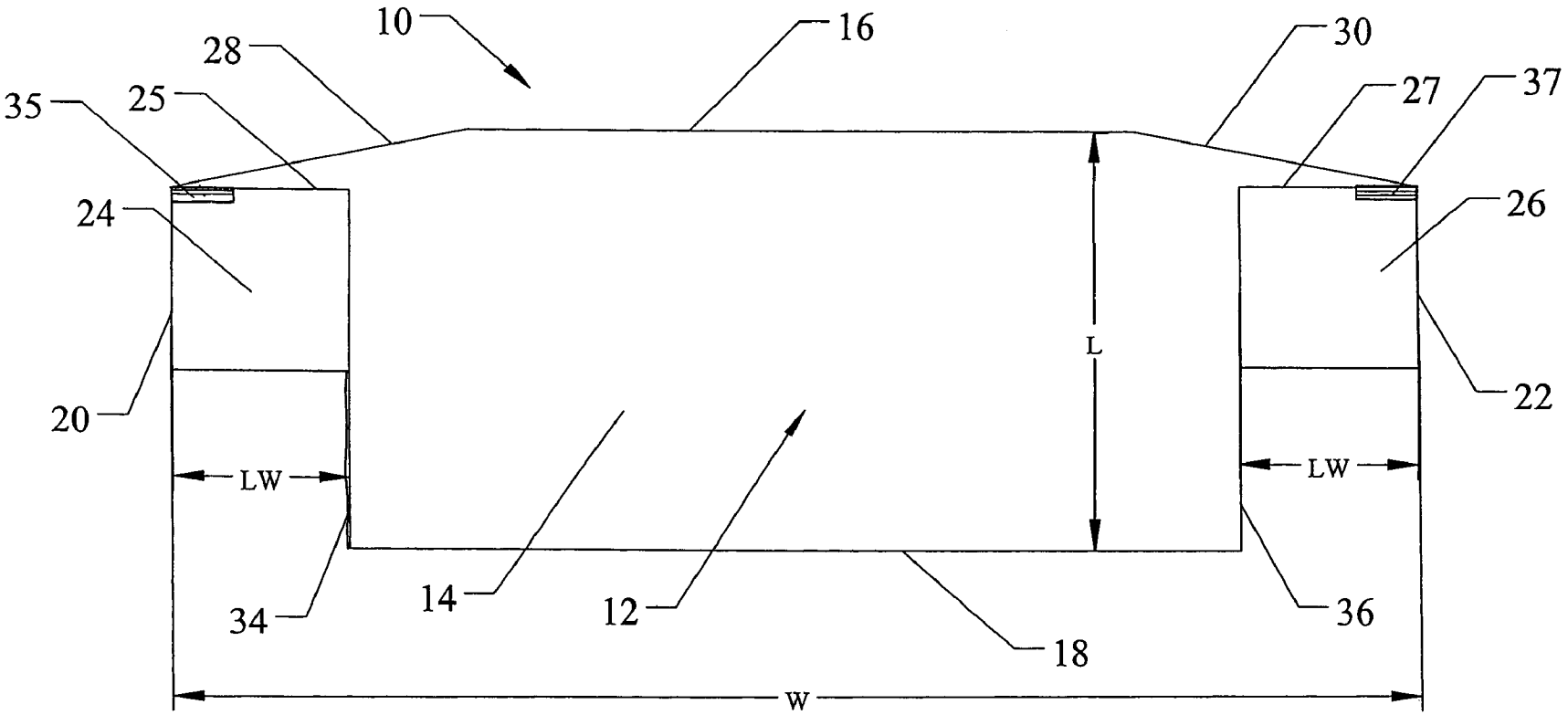
FIG. 1 is a front view of a basic embodiment of the shawl of the present invention
Figure 2:
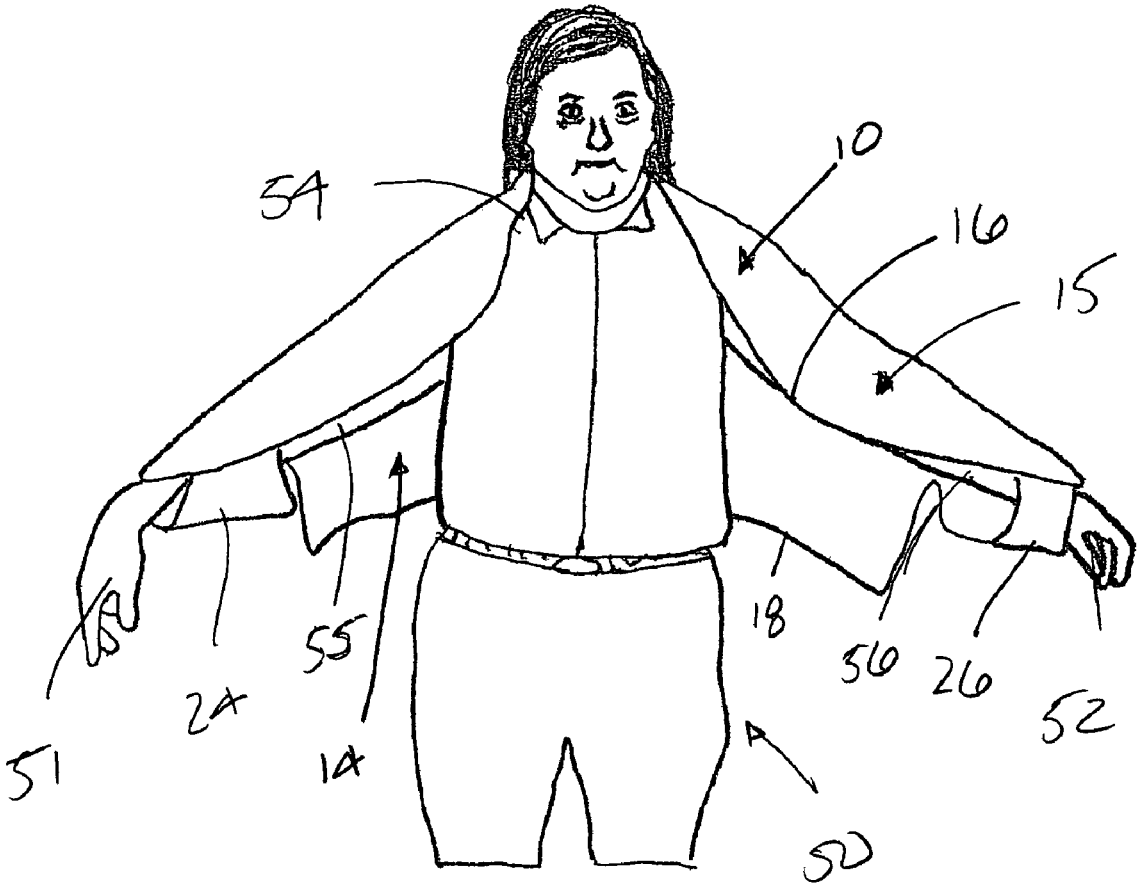
FIG. 2 is a front view of a basic embodiment of the shawl of the present invention wrapped around a user.

Referring first to FIGS. 1 and 2, one basic embodiment of the shawl 10 of the present invention is shown. The shawl 10 includes a sheet 12 of fabric having an inner surface 14 and an outer surface 15 defined by a top edge 16, a bottom edge 18, a right side edge 20 and a left side edge 22. The sheet 12 is dimensioned to allow the right and left hands 51, 52 of the user to each extend beyond the right side edge 20 and left side edge 22 of the sheet 12 when the top edge 16 of the sheet 12 is draped over the user's shoulders 54. A right arm closure 24 extends from the inner surface 14 of the sheet 12 proximate to the right side edge 20, and a left arm closure 26 extends from the inner surface 14 of the sheet 12 proximate to the left side edge 22. Each of the arm closures 24, 26 has a width "LW" that is less than a width of a human forearm 56 and defines an opening 34 dimensioned to allow the user's hands 51, 52 to pass therethrough.

As shown in FIG. 2, the user 50 will drape the shawl over their shoulders 54 such that the arm closures 24, 26 are substantially evenly disposed proximate to the user's hands 51, 52. The user 50 will then insert their hands 51, 52 through the arm closures 24, 26 and allow the arm closures 24, 26 to slide up to their forearms 55, 56, which holds the shawl 10 in place.

The sheet 12 is manufactured of any material commonly used in the textile arts. The preferred sheet 12 is manufactured of a fabric material, such as a polypropylene fleece, terry cloth, cotton, or the like, which has an inner surface 14 that is soft to the touch and provides the user with insulation from the cold. In some embodiments, the outer surface 15 and inner surface 14 are formed from two or more sheets of materials, which are joined together by stitching, gluing, ultrasonic joining, or other art recognized methods of joining fabrics together. The outer surface 15 is generally visible when worn by the user and, therefore, is preferably manufactured of a material having a design, pattern or other ornamentation to allow the shawl 10 to provide the user with a finished and stylish appearance. In other embodiments, the outer surface 15 is formed of a water resistant material to provide the user with protection from rain or snow, although such embodiments are preferably lined with a material that prevents the inner surface 14 from irritating the skin of the user.

In the embodiment of FIG. 1, the right and left arm closures 24, 26 are each formed as an integral part of the sheet 12 of fabric. As shown in FIG. 1, this may be accomplished by cutting the sheet upward from the bottom edge 18 along lines 34, 36, folding the fabric upward toward the top edge 16, and joining the free ends 25, 27 of the folded fabric to the inner surface 14 of the sheet 12. In this embodiment, it is preferred that only a portion of the free ends 25, 27 of the folded fabric be joined to the inner surface 14 of the sheet 12 in the area proximate to the right side edge 20 and left side edge 22, with the preferred joining lines 35, 37 are shown in FIG. 1. However, in other embodiments, substantially all of the free ends 25, 27 are joined. In the embodiment of FIG. 1, the free ends 25, 27 of the folded fabric are permanently joined by stitching them to the inner surface 14 of the sheet 12. However, in other embodiments, the free ends are removably attached to the inner surface 14 using hook and loop fasteners, snaps, buttons or other art recognized methods of removably fastening one fabric to another.

Figure 3:
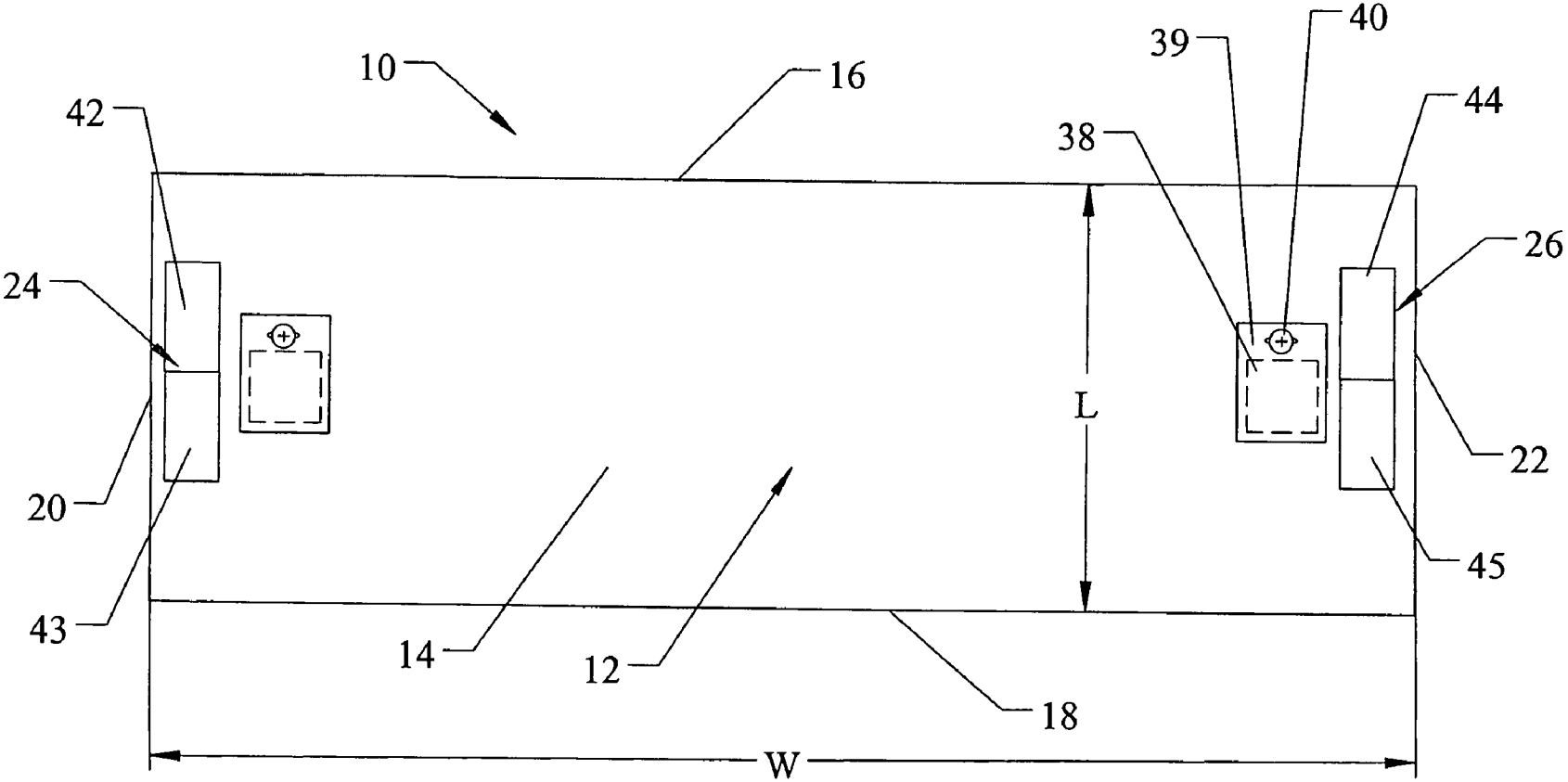
FIG. 3 is a front view of an alternative embodiment of the shawl of the present invention in which the arm closures are separate sheets of material added to the inner surface of the shawl and in which weights are secured thereto.

Although the embodiment of FIG. 1 utilizes right and left arm closures 24, 26 formed from the sheet 12, other embodiments may utilize arm closures 24, 26 that are attached to the inner surface 14 of the sheet 12. As shown in FIG. 3, the arm closures 24, 26 may be formed from first ends 42, 43 and a second ends 44, 45 of a hook and loop fastener that are mated together around the wrists of the user to form the arm closures 24, 26 once the shawl 10 is wrapped about the user. In such an embodiment, it is preferred that the surface of the first end 42 and second end 44 that contacts the skin of the user be manufactured of a material that is soft to the skin. However, in still other embodiments, the right and left arm closures 24, 26 are merely loops of fabric or an elastic material that are attached to the inner surface 14 of the sheet 10 proximate to the right side edge 20 and left side edge 22 respectively. Regardless of the form taken by the right and left arm closures 24, 26, the closures are each sized and positioned to contact the wrist and/or forearm of the user to retain the shawl 10 over the user's shoulders without grasping the shawl 10 with their hands.

As noted above, the shawl 10 may utilize the sheet 12 itself to form the right and left arm closures 24, 26 and, in such embodiments, has a bottom edge 18 with a width less than the overall width W of the sheet 10. However, as shown in FIG. 3, in embodiments in which the right and left arm closures 24, 26 are added, the bottom edge 18 of the sheet may have a width equal to, or even greater than, the overall width "W" of the sheet 12 from the right side edge 20 to the left side edge 22 proximate to the arm closures 24, 26. Referring again to FIG. 1, the shawl 10 may include tapered portions 28, 30 that extend from the top edge 16 of the sheet 12 to the right side edge 20 and left side edge 22 respectively. These tapered portions are intended to allow the shawl to conform to the shape of the shoulders and fall neatly over the user. However, as shown in FIG. 3, these tapered portions 28, 30 may be eliminated such that the sheet 12 is substantially rectangular in shape.

The embodiment of FIG. 3 also includes a pair of weights 38 that are secured to the inner surface 14 of the sheet 12 of fabric. The use of weights 38 is preferred in embodiments for use by people having disease processes, such as Parkinson's disease or multiple sclerosis, in which shaking of the hands is a common symptom, as the added weight tends to reduce the effect of this shaking. The weights 38 are preferably flexible "beanbag" type weights that are dimensioned to fit within a pocket 39 sewn on the inner surface 14 and secured using an art recognized closure, such as a button 40, snap, or hook and loop fastener. This is preferred as it allows the user to determine whether or not to use the weights 38, allows the mass of the weights 38 to be varied, and allows the weights to be easily removed during cleaning of the shawl 10. However, it is understood that the weights 38 may be permanently affixed to the shawl 10 by sewing or other art recognized means of securing an item to a piece of fabric.

Figure 4:
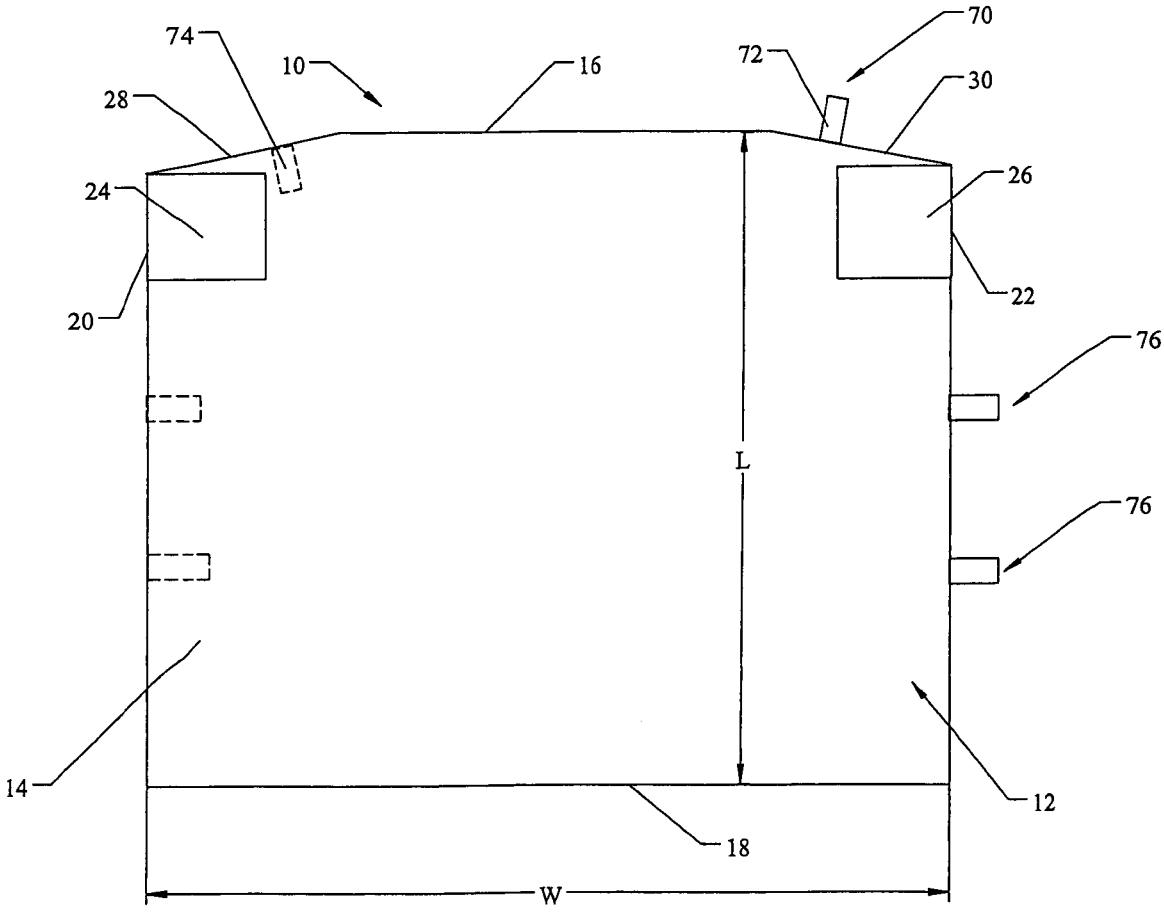
FIG. 4 is a front view of an alternative embodiment of the shawl of the present invention in which its length is extended such that the bottom edge extends below the knee of the user and in which a series of closures are provided to secure the shawl about the chest of the user.

The preferred shawl 10 is intended to cover only the torso of the user and is dimensioned such that the width dimension "W", measured between the right side edge 20 and the left side edge 22, is greater than a length dimension "L", measured between the top edge and the bottom edge and, in the preferred embodiment, the width "W" is approximately sixty inches, while the length "L" is approximately thirty-six inches. This arrangement is preferred as many people who would have a use for such a shawl 10 spend more time sitting than standing and require coverage only down the back to the waistline. However, as shown in FIG. 4, other embodiments of the shawl 10 are dimensioned to allow the bottom edge 18 of the sheet 12 to extend below a knee of the user in a manner similar to that of a conventional bathrobe. Such an embodiment is intended for use with people who are ambulatory and need the warmth while walking. In order and is ideally suited for use by people who use walkers or canes.

As noted above, the basic embodiment of the shawl uses only the users forearms to retain the shawl 10 in place. However, as shown in FIG. 4, other embodiments include at least one chest closure 70 disposed upon the sheet 12 of fabric proximate to the top edge for securing the left and right side edges 20, 22 of the top edge 16 of the shawl 10 together when the shawl 10 is draped over the user. The preferred chest closures 70 are hook portions 72 and loop portions 74 of hook and loop fasteners that are disposed at locations proximate to the top edge 16 of the sheet 12 such that the hook portion 72 may be mated with the loop portion 74 when the top edge of the sheet of fabric is draped over the pair of shoulders of the human user. These are preferred due to the ease with which such chest closures 70 may be both fastened and removed. However, other art recognized closures, such as buttons, snaps of the like may be substituted to achieve similar results. Further, as also shown in FIG. 4, some embodiments also include at least one torso closure 76, to allow the a torso of the user to be substantially covered by the sheet 12 of fabric, providing additional warmth to the user. As shown in FIG. 4, this closure is also made up of a hook portion 78 and loop portion 80 of a hook and look fastener, although any art recognized type of closure may be used. Finally, it is recognized that both the chest closure 70 and torso closures 76 may be utilized in any embodiment of the invention, and not merely in those extending below the waist of the user.

Figure 5:
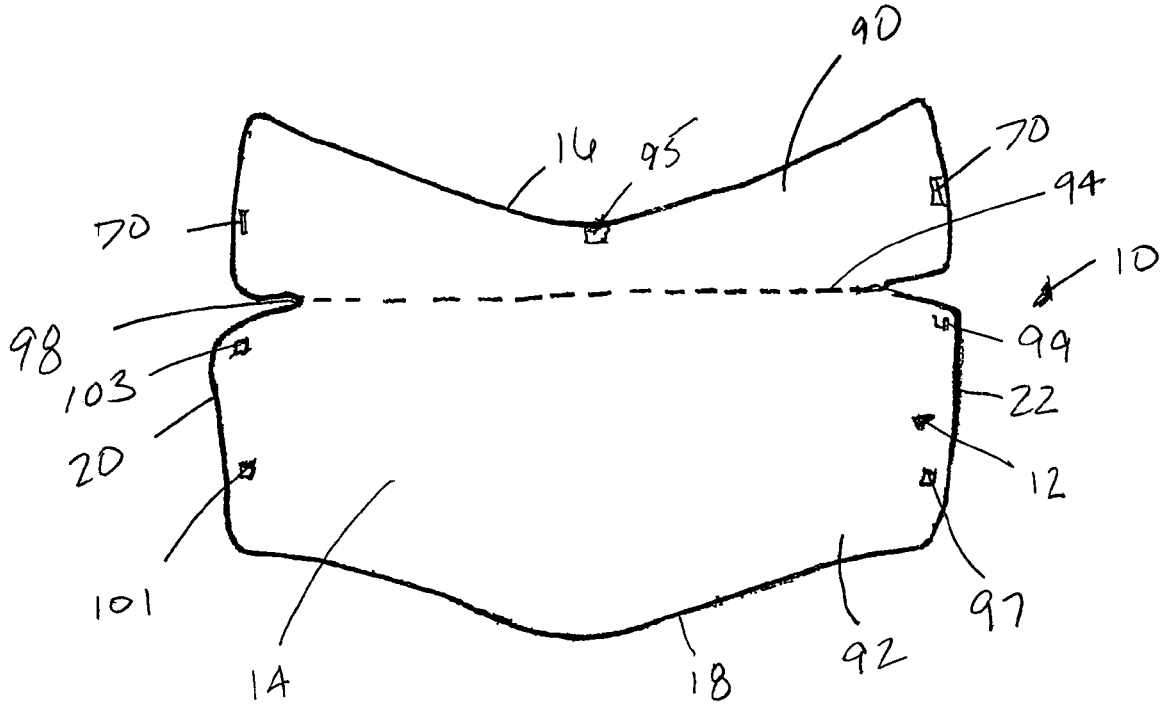
FIG. 5 is a front view of the preferred embodiment of the shawl of the present invention.
Figure 6:
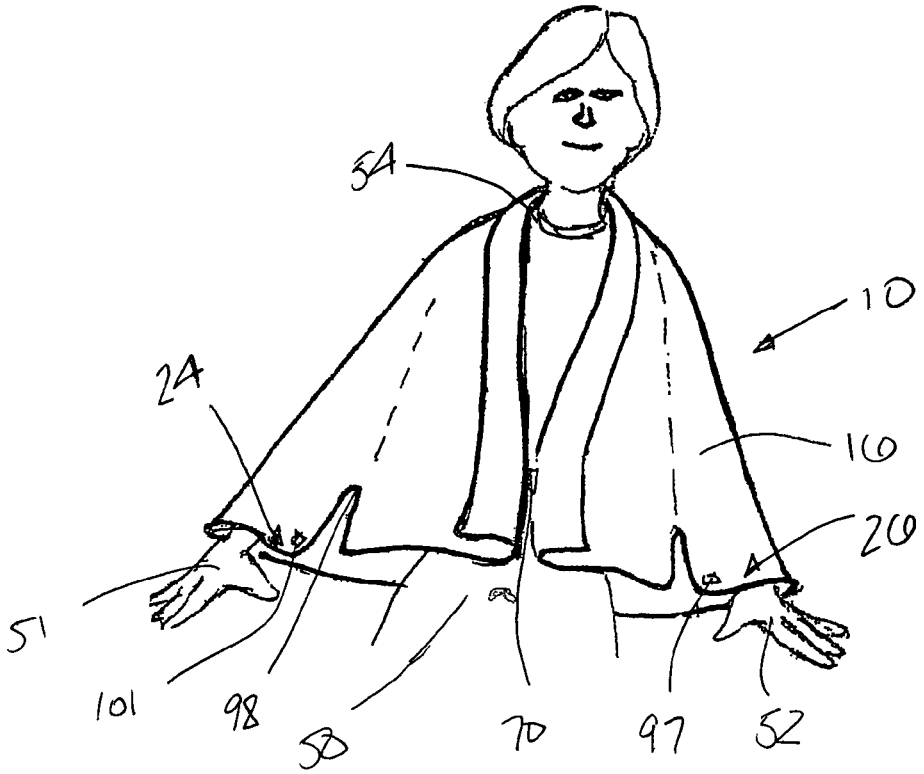
FIG. 6 is a front view of the preferred embodiment of the shawl of the present invention wrapped around a user.

Referring now to FIGS. 5 and 6, the preferred embodiment of the shawl 10 is shown. As was the case with the other embodiments of the shawl 10, the preferred shawl includes a sheet 12 of fabric having an inner surface 14 and an outer surface 15 defined by a top edge 16, a bottom edge 18, a right side edge 20 and a left side edge 22. However, the preferred sheet 12 of fabric is made up of two pieces of fabric that are joined together along a joining line 94 to form a shawl portion 92 and a collar portion 90. The collar portion 90 is designed to fold over on itself and the joining line 94 is placed such that the collar portion 90 falls easily over the neck and shoulders of the user 50. The joining line 94 of this preferred embodiment terminates in a pair of notches 98 that allow the user's arms a greater degree of freedom than would be possible were they restrained entirely by the sheet 12 of fabric. The preferred shawl 10 includes a number of hook and loop fasteners 70, 95, 97, 99, 101 & 103, which perform various functions.

The collar fastener 95 at the top of the collar portion 90 is intended to allow the collar to be secured to the outer surface 16 of the shawl portion 92 of the sheet 12 of fabric when desired, while allowing the collar portion to be extended upward to provide more warmth if desired. However, it is understood that this collar fastener 95 may take many of the same forms discussed herein, may be eliminated completely, or may be replaced by threads that permanently fold the collar portion 90 downward.

Chest closures 70 are provided at the right side edge 20 and left side edge 22 of the collar portion 90 and perform the same function as those described above with reference to FIG. 4. Again, these may be replaced with other types of closures, or eliminated completely in other embodiments.

Hook portions 97 and 101 and loop portions 99 and 103 are provided on the inner surface of the shawl portion 92 of the shawl and are dimensioned to be joined together to form the left an right arm closures 26, 24. This arrangement is preferred due to the ease of attachment and detachment of these types of fasteners during use. However, it is recognized that any of the other arm closure 24, 26 described herein may be substituted to achieve similar results.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An improved shawl comprising:

a sheet of fabric comprising an inner surface and an outer surface defined by a top edge, a bottom edge, a right side edge and a left side edge, wherein said sheet of fabric is dimensioned to allow a right hand and a left hand of a human user to each extend beyond said right edge and said left edge of said sheet of fabric when said top edge of said sheet of fabric is draped over a pair of shoulders of the human user;

a right arm closure extending from said inner surface of said sheet of fabric proximate to said right edge, said right arm closure comprises a width that is less than a width of a human forearm and defines an opening dimensioned to allow said right hand to pass therethrough;

a left arm closure extending from said inner surface of said sheet of fabric proximate to said left edge, wherein said left arm closure comprises a width that is less than a width of a human forearm and defines an opening dimensioned to allow said left hand to pass therethrough;

a right side weight secured to said inner surface of said sheet proximate to said right arm closure; and a left side weight secured to said inner surface of said sheet proximate to said left arm closure.

2. The shawl of claim 1 wherein at least one of said right arm closure and said left arm closure are formed as an integral part of said sheet of fabric.

3. The shawl of claim 1 wherein at least one of said right arm closure and said left arm closure comprises a first end and a second end upon which are disposed a hook portion and a loop portion of a hook and loop fastener, and wherein said hook portion of is mated with said loop portion to form said arm closure.

4. The shawl of claim 1 further comprising at least one closure disposed upon said sheet of fabric proximate to said top edge.

5. The shawl of claim 4 wherein said at least one closure comprises at least one hook and loop fastener comprising a hook portion disposed and a loop portion, wherein said hook portion and said loop portion of said hook and loop fastener are disposed at locations proximate to said top edge of said sheet of fabric such that said hook portion may be mated with said loop portion when said top edge of said sheet of fabric is draped over the pair of shoulders of the human user.

6. The shawl of claim 5 wherein said at least one hook and loop fastener comprises at least two hook and loop fasteners and wherein said hook portions of said hook and loop fasteners are disposed at locations proximate to said top edge of said sheet of fabric such that each of said hook portions may be mated with one of said loop portions when said top edge of said sheet of fabric is draped over the pair of shoulders of the human user such that at least a torso of the human user is substantially covered by said sheet of fabric.

7. The shawl of claim 1 wherein said sheet of fabric is dimensioned such that a width dimension measured between said right edge and said left edge is greater than a length dimension measured between said top edge and said bottom edge.

8. The shawl of claim 7 wherein said length dimension is sufficient to cover a torso of the human user.

9. The shawl of claim 7 wherein said length dimension is sufficient to cover a torso and extend below a knee of the human user.

10. The shawl of claim 1 wherein said sheet of fabric comprises a collar portion and a shawl portion.

11. The shawl of claim 10 wherein said collar portion and said shawl portion of said sheet of fabric are joined together by a threaded seam along a joining line.

12. The shawl of claim 10 further comprising at least one collar fastener disposed upon said collar portion and adapted to secure said collar portion to shawl portion when said collar portion is folded along said joining line.

13. An improved shawl comprising:

a sheet of fabric comprising an inner surface and an outer surface defined by a top edge, a bottom edge, a right side edge and a left side edge, wherein said sheet of fabric is dimensioned to allow a right hand and a left hand of a human user to each extend beyond said right edge and said left edge of said sheet of fabric when said top edge of said sheet of fabric is draped over a pair of shoulders of the human user;

a right arm closure extending from said inner surface of said sheet of fabric proximate to said right edge, said right arm closure comprises a width that is less than a width of a human forearm and defines an opening dimensioned to allow said right hand to pass therethrough;

a left arm closure extending from said inner surface of said sheet of fabric proximate to said left edge, wherein said left arm closure comprises a width that is less than a width of a human forearm and defines an opening dimensioned to allow said left hand to pass therethrough;

a right weight pocket attached to said inner surface of said sheet proximate to said right arm closure; and a left weight pocket attached to said inner surface of said sheet proximate to said left arm closure.

14. The shawl of claim 13 wherein at least one of said right arm closure and said left arm closure are formed as an integral part of said sheet of fabric.

15. The shawl of claim 13 wherein at least one of said right arm closure and said left arm closure comprises a first end and a second end upon which are disposed a hook portion and a loop portion of a hook and loop fastener, and wherein said hook portion of is mated with said loop portion to form said arm closure.

16. The shawl of claim 1 further comprising at least one closure disposed upon said sheet of fabric proximate to said top edge.

17. The shawl of claim 13 further comprising a right side weight disposed and secured within said right weight pocket and a left side weight disposed and secured within said left weight pocket.

* * * * *